United States Patent [19]

Schleese et al.

[11] 4,359,860

[45] Nov. 23, 1982

[54] MAKING ELECTRICAL CABLE

[75] Inventors: Eckard Schleese, Stadthagen; Wolf Günther, Rodenberg; Willi Buddensiek, Nordsehl, all of Fed. Rep. of Germany

[73] Assignee: Kabel-und Metallwerke Gutehoffnungshütte AG, Hanover, Fed. Rep. of Germany

[21] Appl. No.: 274,449

[22] Filed: Jun. 17, 1981

[30] Foreign Application Priority Data

Jun. 21, 1980 [DE] Fed. Rep. of Germany ..... 3023257

[51] Int. Cl.[3] ..... H01B 13/04

[52] U.S. Cl. ..... 57/293; 57/6; 57/13; 57/14; 57/294

[58] Field of Search ..... 57/3, 6, 9, 293, 294, 57/13, 14

[56] References Cited

U.S. PATENT DOCUMENTS

| | | | |
|---|---|---|---|
| 3,645,079 | 2/1972 | Stoebener | 57/294 |
| 4,002,011 | 1/1977 | Tanaka et al. | 57/6 X |
| 4,056,925 | 11/1977 | Vogelsberg | 57/293 |
| 4,214,430 | 7/1980 | Vogelsberg et al. | 57/6 |
| 4,266,398 | 5/1981 | Vogelsberg | 57/293 |
| 4,266,399 | 5/1981 | Ellis, Jr. | 57/293 |

*Primary Examiner*—John Petrakes

*Attorney, Agent, or Firm*—Ralf H. Siegemund

[57] ABSTRACT

The cable is made by cascaded SZ pattern stranding of elements (individual conductors, or bundles) in a first stranding level by means of multiple units each having a stationary aperture disk, a reversably revolving aperture disk, a tube between them, and a stranding head downstream from the revolving disk, with a wrapping station between them, resulting in plural, stranded bundles serving as stranding elements in a further unit for second-level stranding and being basically similarly constructed as each of the first-mentioned units.

3 Claims, 3 Drawing Figures

1'
2
3'
4
5
6
6'
12
12'
13
14
16
18
19
M

MAKING ELECTRICAL CABLE

BACKGROUND OF THE INVENTION

The present invention relates to the making of stranded electrical cables.

Stranded cables are usually constructed with a reversing pitch; or at least, this is generally so desired. Stranding is provided by running individual stranding elements through the bores of a stationary guide disk. These stranding elements are then run through a reversibly revolving disk which is also provided with such guide bores. The central area between the two disks is occupied, e.g., by a smooth wall tube about which the elements are stranded. A stranding head is disposed downstream from the revolving disk.

Cables within the pertinent field of art are, for example, communication cables, or other multiconductor cables or bundles. Stranding elements are, correspondingly, leads and conductors but also conductor bundles such as pairs, quads or even larger bundles.

Stranding with a reversing twist (SZ-stranding) is superior to stranding with a uniform twist because one does not need revolving take-up spools.

Canadian Pat. No. 963 361 discloses a stranding machine which includes a stationary disk and a revolving disk, and the stranding elements are run through hoses between these disks. These hoses are made of a material having a very low coefficient of friction; they prevent bunching and tangling of the stranding elements. This approach is disadvantaged by the fact that initially a rather complicated procedure of threading long portions of the stranding elements into and through these hoses is required. Also, some friction is inevitable, leading to a fairly rapid wear-out of the hoses, requiring their frequent exchange. Also, some entanglements must also be expected, particularly if the two disks are rather far apart.

The German Pat. No. 26,15,275 describes a device for stranding elements which, by themselves, are SZ-stranded bundles. The device includes a stationary guide disk and a revolving disk, each one being circumscribed by an annulus which is also provided with apertures. An outer guide tube extends between these two disks, being held by the annular gaps between the respective disk and the circumscribing annulus. A second tube of smaller diameter extends between the two disks so that there remains a rather large gap between the two tubes. Stranding is carried out with two sets of stranding elements; one set or group runs through the apertures in the annuli, the other one through the apertures in the disks, extending all the while in that gap between the tubes while the first set of elements extends outside but along the larger tube. This device thus strands in two layers. Bundle cables of the type shown for communications in German Pat. No. 15,15,812 cannot be made in that manner. Moreover, the device of German Pat. No. 26,15,275 does not lend itself readily to the inclusion of a colored lay for identifying the individual lays.

German printed patent application No. 24 11 151 illustrates a device being closest to the summary description above. As per this publication, a core is made by stranding elements without a reversing twist, and additional stranding elements are then placed on top, but now with a reversing twist. The machine for the latter operation includes the two disk arrangements as mentioned. This structure permits stranding of but one lay onto such a core that is concurrently formed.

DESCRIPTION OF THE INVENTION

It is an object of the present invention to provide a new and improved machine, device, or apparatus for making a cable from bundled SZ-stranded units, the cable to have also an SZ-stranding pattern.

In accordance with the preferred embodiment of the present invention, it is suggested to provide a plurality of stranding units, each having a stationary aperture disk, a revolving aperture disk, a guide tube fastened to one of the disks and extending between them; a stranding head and a ribbon-wrapping device between the revolving disk and the head. Plural stranding elements are fed from stationary supply sources to all stationary disks; and by means of reversibly driving all the revolving disks in unison a plurality of stranded bundles are produced which, in turn, are fed to a stationary aperture disk of a further stranding unit having also a reversibly rotating aperture disk, a guide tube between them and a stranding head downstream from the latter rotating disk, for obtaining a higher-order stranded bundle. All stranding is, thus, carried out in the SZ pattern. A stationary supply source is to mean that it does not revolve about any stranding axis. Use of a common drive motor for the units of the plurality greatly simplifies construction. The ribbon wrapping may be used to include proper cable markings, such as using differently colored ribbons.

It can readily be seen that the inventive system does not produce multy-lay stranding but multi-level stranding, whereby particularly in one step at least a two-level stranding bundle is produced, and each stranding level is operated to obtain an SZ-stranding pattern. Except for reversibly revolving stranding disks, no other revolving parts are used. The stranding proper occurs in each instance between the revolving disk and the head, the space between the two disks in a unit serves for temporary storage.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, FIG. 1 depicts a stranding unit 1 which includes a stationary disk 2 having a group of annularly arranged apertures 11 (FIG. 2). A tube 4 extends from that disk 2 towards a rotatably mounted stranding disk 5, being mounted in bearings 8. A stranding nipple or head 6 is disposed beyond disk 5, and a stranded bundle 3 leaves the head in the direction of arrow 7. A traction device or the like (not shown) is disposed downstream from head 6 to pull the bundle and all of the individual stranding elements through the machine or unit.

Figure 1:
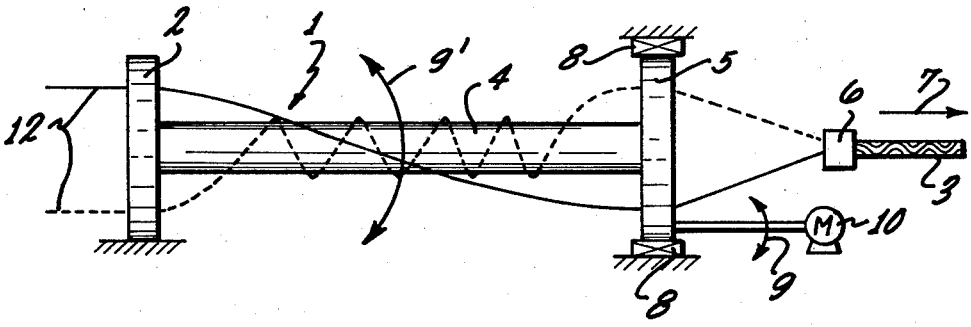
FIG. 1 is a schematic view, in side elevation, of a stranding device, to be used in a system in accordance with the preferred embodiment of the invention.
Figure 2:
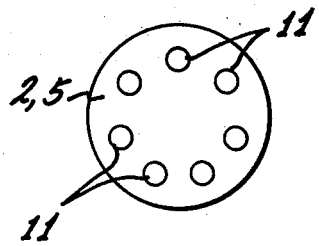
FIG. 2 is a front view of a stranding or guiding disk used in the device of FIG. 1.

As schematically indicated, the stranding disk 5 is driven by a reversible motor 10, the reversal is denoted by the double-arrow 9. A plurality of stranding elements, such as element 12, are fed toward, into and through the apertures of disk 2 and from there to and through the apertures of disk 5 to be combined by the stranding head 6. Only two stranding elements are shown for the sake of clarity, and they are shown in different states of twist for purposes of illustration only; normally, all of the stranding elements exhibit the same degree of twisting.

The tube 4 is preferably stationary, i.e. nonrevolving and is fastened to stationary disk 2 accordingly. Consequently, it must be held in bearings in revolving disk 5. However, the situation may be reversed in that tube 4 is fastened to and revolves with disk 5. In either case, tube 4 is preferably made of steel with a fine, smooth surface finish in order to reduce friction. Preferably, however, one should coat the tube with an antifriction layer.

The apparatus or unit 1 operates as follows: Initially, stranding elements 12 are fed through the apertures of disks 2 and 5, through nipple 6 toward a device that pulls them (not yet stranded but loosely bundled) through the machine (arrow 7). As the advance of the elements commences and proceeds disk 5 is set into rotating motion, but the rotation will alternate in, preferably, regular intervals. For example, disk 5 will undergo eight revolutions before reversing, again eight revolutions are provided before another reversal; and so forth.

Upon start-up disk 5 will revolve four times in one direction so that the stranding elements have formed four loops around tube 4. Thereafter, the disk reverses and rotates in opposite direction, but now for eight revolutions. This will amount to an untwisting followed by forming four loops with the opposite pitch. Thereafter, the operation proceeds regularly by reversing after eight revolutions in each direction so that four loops maximum can build up on tube 4 in one or the opposite twist. These numbers are, of course, by way of example only; but they are preferred for communication cables.

Stranding proper occurs between the revolving disk and the head 6. The elements are immediately combined downstream from disk 5 in the head 6 so that the SZ twist is not "undone."

Figure 3:
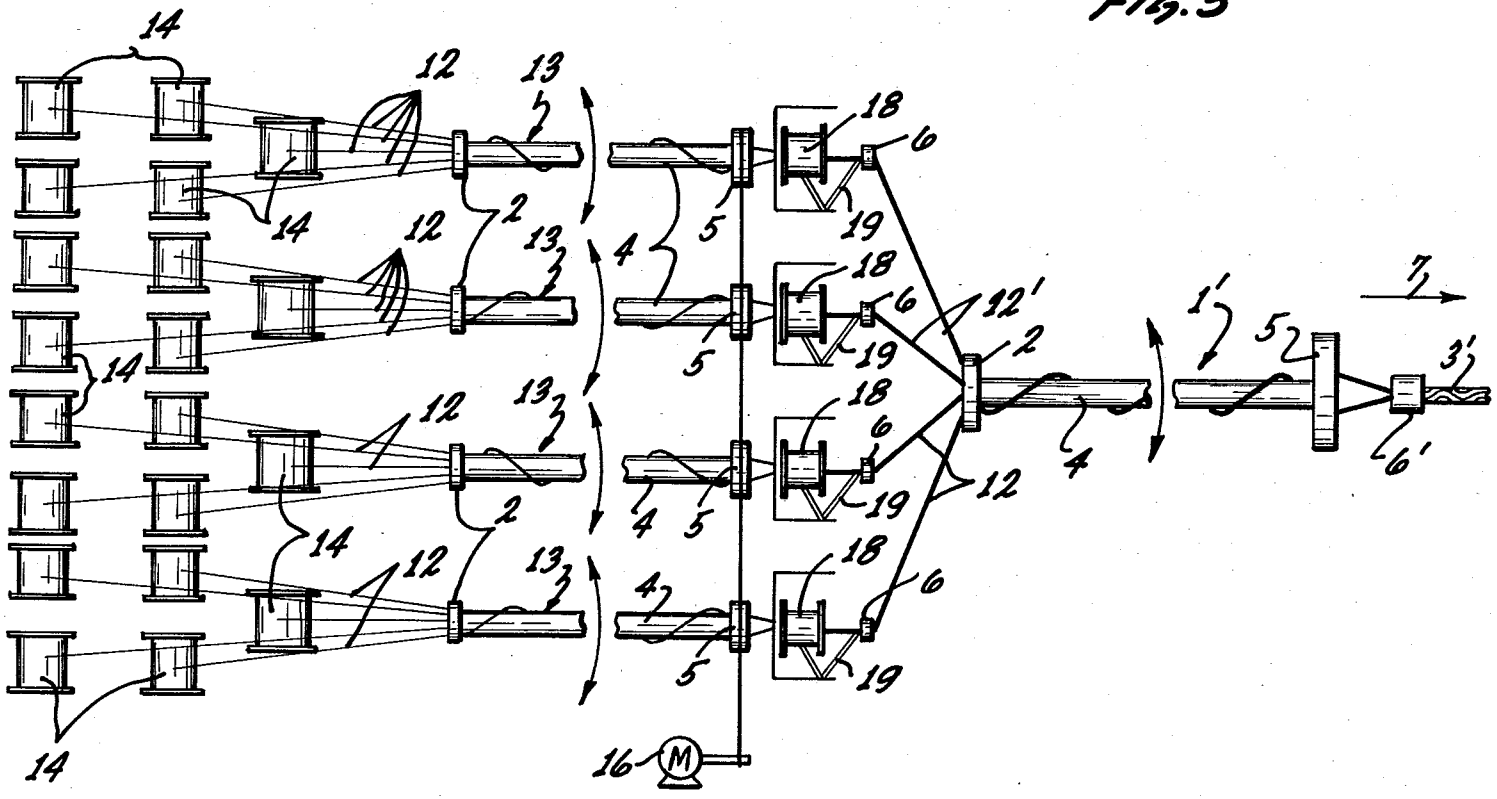
FIG. 3 is a schematic view of a stranding apparatus for practicing the best mode of the invention in accordance with the preferred embodiment thereof.

Turning now to FIG. 3, the apparatus as depicted therein illustrates four units 13 each one constructed as a unit 1 shown in FIG. 1; and a further, fifth unit 1' is similarly constructed, except that it is designed on a somewhat larger scale because it has to handle thicker stock. Also, the number of units 13 is by way of example only, more or less can be used; but there must be at least two of them.

Also, units 13 include a modification. Each of them is provided with a ribbon-wrapping station 18 between the respective disk 15 and the head 6. This station wraps a ribbon 19 about the respective bundle just ahead of its entry into the stranding head 6.

Each of the four units 13 produces a stranded bundle 3; and each of these becomes a stranding element 12' in device 1'. The heads 6 produce, so to speak, these stranding elements; and a completed cable 3' leaves head 6'. One can readily see that this cable 3' may actually be a stranding element for another stranding unit. Also, each of the input stranding elements 12 may have resulted from stranding filaments, etc. The cascading of stranding units is limited only by aspects of practicality, management, and handling of so many units. Each of the stranding elements 12' is wrapped in a ribbon. Different colors for the ribbons facilitates identification and tracing of a particular bundle 12'.

Reference numeral 14 refers to a plurality of spools or supply drums for paying out the stranding elements 12. The spools rotate about stationary axes; but neither the entire assembly of spools 14 nor any individual spool revolves about any stranding axis. Thus, one may use, in the alternative, stationarily stored, coiled stock, stored inside a drum, a barrel, etc. These stranding elements 12 may be, as stated, stranded bundles, such as stranded triples, quads, pairs, etc. or higher-order bundles; or they may be individual conductors.

The various disks 5 in units 13 are driven by a common electrical reversing motor 16 via a transmission 17 being, e.g., a belt. Depending upon the chosen construction, the tubes 4 may likewise revolve. In any event, all stranding devices 13 run in parallel and cause stranding at the same rate, with the same twist, including the reversal. Thus, the stranding elements 12' are each similarly stranded, at reversing twists. Conceivably, however, the belt 7 is run through the system such that some of the disks 5 revolve in one direction, others in the opposite direction at any given time. All reverse in unison.

The device operates as follows: The stranding elements 12, being of the lowest stranding order within the depicted system, are paid from the supplies 14 and are respectively passed through the apertures of the stationary disks 2; the elements 12 run along the respective tubes 4 and are passed through the apertures of the rotating disk 5. The various heads 6 now from the next order of stranding elements 12', each being appropriately wrapped. The elements 12' are now stranded together in the unit 1' which may likewise be operated for SZ-stranding, i.e., with twist reversal. The disk 5 of this additional unit may be independently driven because the twist pattern may well be different from the patterns in each stranding element 12'.

By way of example, each of the stranding units 13 may combine four stranding elements 12. If they are individual conductors, each unit 13 will, in fact, produce a quad. The unit 1' now combines, e.g., several of such quads to a basic bundle 3. Usually, one may wish to combine five quads at this point. The transmission system may in this case be constructed to impart different speeds upon the various disks 5 so that they reverse after a different number of revolutions.

The drawing shows all disks 5 of the units 13 to be driven in unison at the same speed by operation of the transmission 17 and a single drive. As stated, this may be modified in that different speeds are imparted upon the various disks. Also, the transmission may be constructed (i.e., the belt is so run) that some units twist in one direction while the others twist in the opposite direction.

If the stranding elements 12 are already pairs, triples, or quads, then the elements 12' constitute basic or core bundles, to be combined by unit 1 into a main bundle, possibly, but not necessarily, being a completed cable 3. On the other hand, the elements 12 may already be basic bundles, i.e., stranded bundles of bundles of quads, pairs, etc., in which case main bundles (12') are produced resulting in cable cores 3, having, in fact, four orders or levels of stranding. To interpret it differently, a system as per FIG. 3, using individual conductors as stranding elements, produces a basic bundle (two levels of stranding). Such basic bundles may then be fed as stranding elements to a system similar to the one shown in FIG. 3, producing two further levels of stranding.

The invention is not limited to the embodiments described above; but all changes and modifications thereof, not constituting departures from the spirit and scope of the invention, are intended to be included.

We claim:

1. A stranding machine, comprising:

a plurality of stranding units, each including (i) a stationary disk with apertures; (ii) a rotatable disk with apertures; (iii) a tube extending between the disks and being fastened to one of them; (iv) a stranding head downstream from the rotatable disk; (v) a wrapping unit disposed between the rotatable disk and the head;

means for feeding stranding elements to said units so that a plurality of stranded bundles leave said heads;

a single drive means connected to all of said rotatable disks for reversibly driving all of the rotable disks;

a further stranding unit having a stationary disk with apertures, a rotatable disk with apertures, a tube extending between the latter disks and being fastened to one of them, a stranding head, and means connected for reversibly driving said latter rotatable disk; and said stranded bundles being fed to said stationary disk of said further stranding unit so that a higher-order stranded bundle may be withdrawn from the head of further stranding unit.

2. In a stranding machine as in claim 1, wherein said drive means imparts different speeds upon said rotatable disks.

3. In a stranding machine as in claim 1 or 2, wherein said single drive means imparts upon some of said rotatable disks rotation in one direction and rotation in the opposite direction upon the remainder of said rotatable disks.

* * * * *